US008408760B2

(12) United States Patent
Bornhorst et al.

(10) Patent No.: US 8,408,760 B2
(45) Date of Patent: Apr. 2, 2013

(54) MOVING LIGHT HOUSING WITH INTEGRATED HANDLES

(75) Inventors: James M Bornhorst, DeSoto, TX (US); Staci A. Mininger, Garland, TX (US); Timothy W. Terleski, Richardson, TX (US)

(73) Assignee: Production Resource Group, LLC, New Windsor, NY (US)

( * ) Notice: Subject to any disclaimer, the term of this patent is extended or adjusted under 35 U.S.C. 154(b) by 509 days.

(21) Appl. No.: 12/427,508

(22) Filed: Apr. 21, 2009

(65) Prior Publication Data

US 2009/0323364 A1 Dec. 31, 2009

Related U.S. Application Data

(60) Provisional application No. 61/076,827, filed on Jun. 30, 2008.

(51) Int. Cl.

| | |
|---|---|
| ***F21S 8/08*** | (2006.01) |
| ***F21V 21/40*** | (2006.01) |
| ***F21V 21/14*** | (2006.01) |

(52) U.S. Cl. ..... 362/419; 362/426; 362/427; 362/428

(58) Field of Classification Search ..... 362/399, 362/272, 271, 275, 418–419, 427–428, 285–287, 362/426

See application file for complete search history.

(56) References Cited

U.S. PATENT DOCUMENTS

| | | | | |
|---|---|---|---|---|
| 4,419,721 | A * | 12/1983 | Gregoire et al. | 362/368 |
| 5,673,989 | A * | 10/1997 | Gohl et al. | 362/35 |
| 7,789,543 | B2 | 9/2010 | Manscher | |
| 2009/0251905 | A1 * | 10/2009 | Melzner et al. | 362/418 |

* cited by examiner

*Primary Examiner* — Robert May

(74) *Attorney, Agent, or Firm* — Law Office of Scott C. Harris, Inc.

(57) ABSTRACT

A lamp assembly, that has a fixed base, and a yoke which is controlled to move relative to the base to cause a panning motion. The yoke holds a lamp head. The yoke has a bottom portion and a top portion. A lamp head, which includes a light source therein, is coupled to said bottom portion of the yoke. The lamp head moves to form a tilting motion, thereby allowing both pan and tilt. The yoke includes handles thereon, including a first handle on a bottom most portion of said yoke, and a second handle on a top most portion of said yoke. One embodiment has the handles integrated into the yoke, e.g., molded to or recessed into the yoke.

12 Claims, 7 Drawing Sheets

MOVING LIGHT HOUSING WITH INTEGRATED HANDLES

This application claims priority from provisional application No. 61/076,827, filed Jun. 30, 2008, the disclosure of which is herewith incorporated by reference.

Moving lights are often used in temporary venues, and moved frequently between the venues. The lights are carried or otherwise conveyed from a warehouse onto a truck, driven to the show, and then eventually hung on a truss. The lights are often handled by a number of different people during the transportation.

Some lights can be handled by a single person, and other lights require multiple different people to carry and hang them. The logistics of the size of lights and the way the lights are handled can cause damage or improper setup.

As lights become physically larger for various reasons, they become heavier and more awkward to handle.

SUMMARY

According to an embodiment, handles are coupled to a yoke of a moving light on both a bottom of the yoke, and of a top of the yoke.

In embodiments, the handles are at the lowest possible portion on the yoke, below the center of gravity of the whole light, and also at the highest possible portion of the yoke, above the center of gravity of the light.

In embodiments, the yoke that supports the moving head is controlled to move in a panning direction. The moving head itself moves in a tilting direction. Motors that are held within the device control the moving between the pan and tilt direction. A control part may also include certain kinds of control mechanisms therein for the motors.

According to an embodiment, the yoke has a handle at a topmost portion/top edge of the yoke, and also at a bottom-most portion of the yoke. In an embodiment, that handle is indented into the yoke in a way that prevents any part of the handle from extending beyond the outer surface defined by the outer part of the yoke. In one embodiment, the handle is molded into the yoke surface.

BRIEF DESCRIPTION OF THE DRAWINGS

These and other aspects will now be described in detail with reference to the accompanying drawings, wherein.

DETAILED DESCRIPTION

Figure 1:
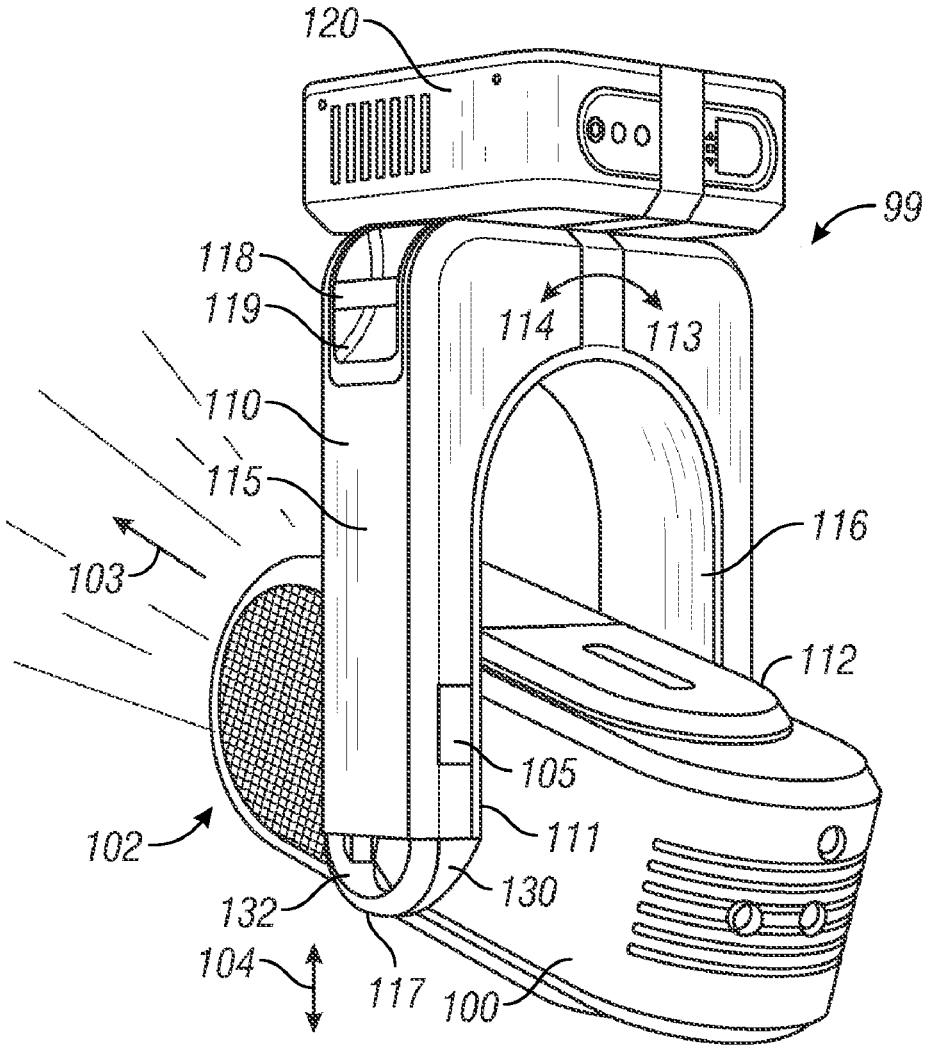
FIG. 1 shows a diagram of the light with the improved handles from the back, with the light as it would be mounted on a truss.

FIG. 1 shows an embodiment of a moving light 99. Moving light 99 has three basic parts, the moving head 100, the yoke 110, and the control/connection part 120.

The moving head 100 produces and controls light, and outputs that light through a light output orifice 102 that forms the optical beam. The output beam of light is along an optical axis 103 which forms the center portion of the projected beam.

The head 100 is movable in the direction shown by arrow 104, in essence up and down relative to the plane of FIG. 1. This direction is referred to herein as the tilt direction, allowing the center portion 103 of the beam of light to be directed upward and downward.

The moving of the head 100 is carried out based on moving motors and drive trains such as 105. These items may be built into the yoke 110. The yoke 110 holds the moving head on both sides of the head, at locations 111, 112. The head 100 is controlled to tilt relative to the yoke, to allow the up and down control.

The yoke 110 is also movable in various directions, shown as 112. The direction of the movement of the yoke in the direction 112 is referred to generally as the pan direction. The motor which carries out the movement can also be in the yoke, shown generally as 113.

In the embodiment, the yoke has two downwardly projecting arms 115,116. Each of the arms holds a respective side of the lighting head. Each arm also terminates in a handle 117, where the other handle cannot be seen in FIG. 1, but is seen in some of the other figures such as FIG. 7. Each light has handle 117, and opposite handle 717. The arm 115 also includes a top handle portion 118. The top handle portion 118 is at the topmost portion of the yoke. In this embodiment, therefore, those handle portions are located at a bottommost portion of the yoke and at the topmost portion of the yoke. This thereby provides the maximum amount of distance between the two handles 117 and 118. As also evident from the drawing of FIG. 1, the handle 117 is generally below the center of gravity of the moving head and light, and the handle 118 is above the center of gravity of the moving head. In general, the handle 118 is as high above the center of gravity of the yoke as possible, and of the lighting instrument as a whole as possible, and the handle 117 is as far below the center of gravity of the lighting instrument as possible.

Another important feature is the way that the handles are formed. In one embodiment, none of the handles have any sharp edges. The handle 117 is rounded, both on the outside surface 130, and also on the inside surface 132. The inside surface 132 in fact forms a holding surface that allows the hand of someone installing the lights to hold the lights in a specified way. Note that in FIG. 1 the holding surface 132 is indented in the sense that it is below the outer surface of the yoke 110. There is also an area which can be held no matter what the position of the head 100. The handle 117 is also curved so that it provides no sharp edges, so both the inner surface 132 which forms the holding surface and also the outer surface 130 are both curved. As shown in FIG. 1, the bottom-most surface of the yoke is always, in all positions of the moving head, next to the light itself. In other words, however the head pivots in FIG. 1, the handle surfaces 132 stay next to that moving head.

This can be advantageous, since the back end of the handle can have a backstop against the light head. The handle can go all the way through the yoke, but the user's fingers can never get behind the yoke in a way that could allow movement of the head from pinching a user's finger for example.

The upper handle 118 is also form indented into the yoke, again so that all surfaces of the handle are lower than the outermost surface of the yoke. Handle 118 is formed from an indented portion 119, and a Rod 117 extending between two opposite walls of the indented portion. The handle 118 is formed at the uppermost area of the yoke, and the handle 117 is formed of the lowermost area of the yoke.

Figure 2:
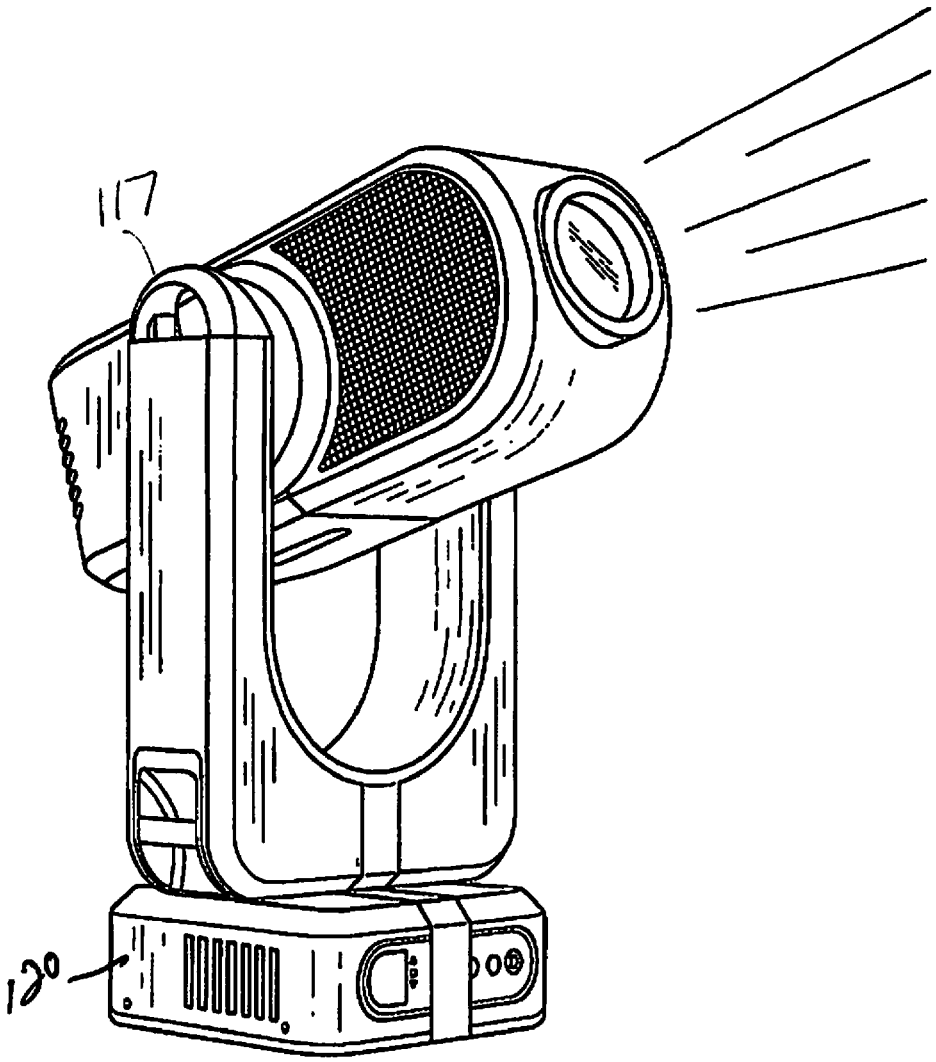
FIG. 2 shows a diagram of the light as mounted base-down.

FIG. 2 shows the lamp in its opposite position, where the base 120 is used as a base for holding the lamp. The lamp can project in this way.

Figure 3:
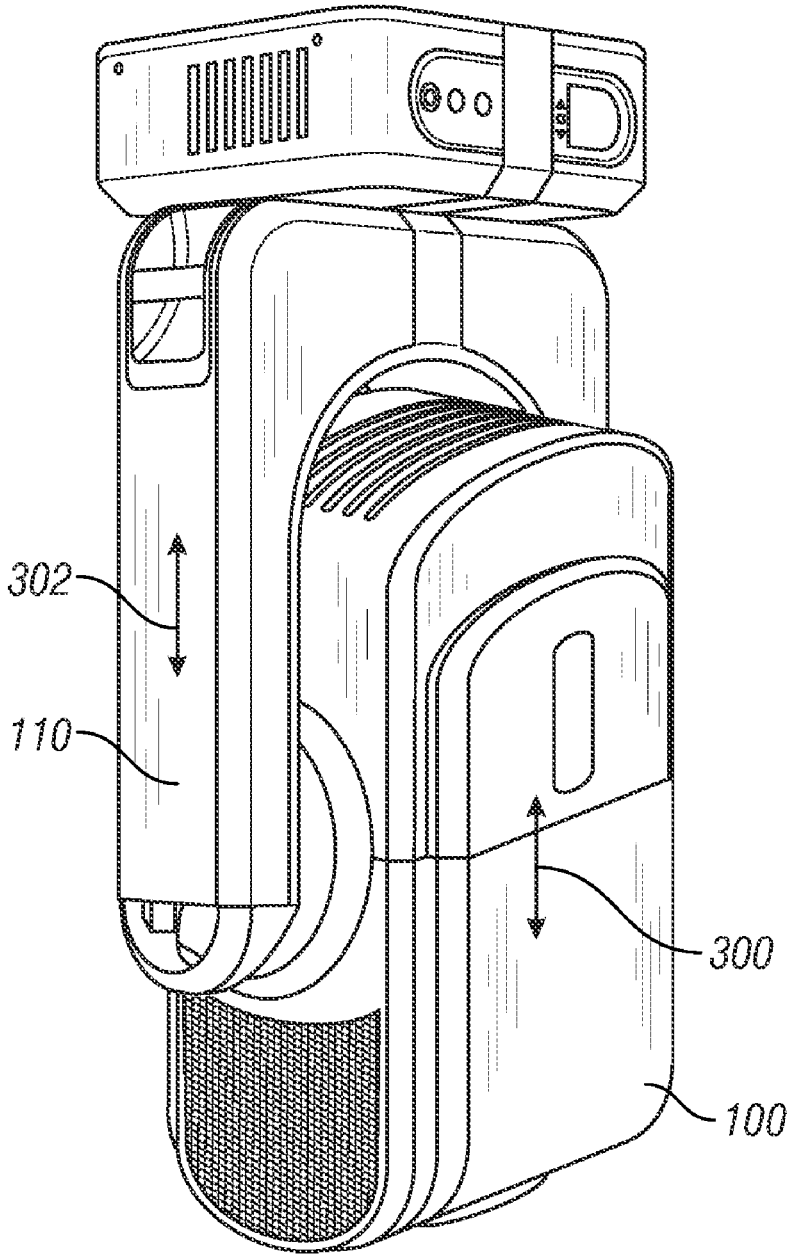
FIG. 3 shows the light in the stowed position, wherein the light is facing completely parallel with the direction of yoke, thereby rendering even the center of gravity with respect to the lateral dimension.

FIG. 3 shows the lamp in a stowed position. When in this position, the moving head 100 is located straight up and down, with its long axis 300 being substantially parallel with the long axis 302 of the yoke. This is called the stowed position, since the moving head and the yoke are in essence parallel.

Figure 4:
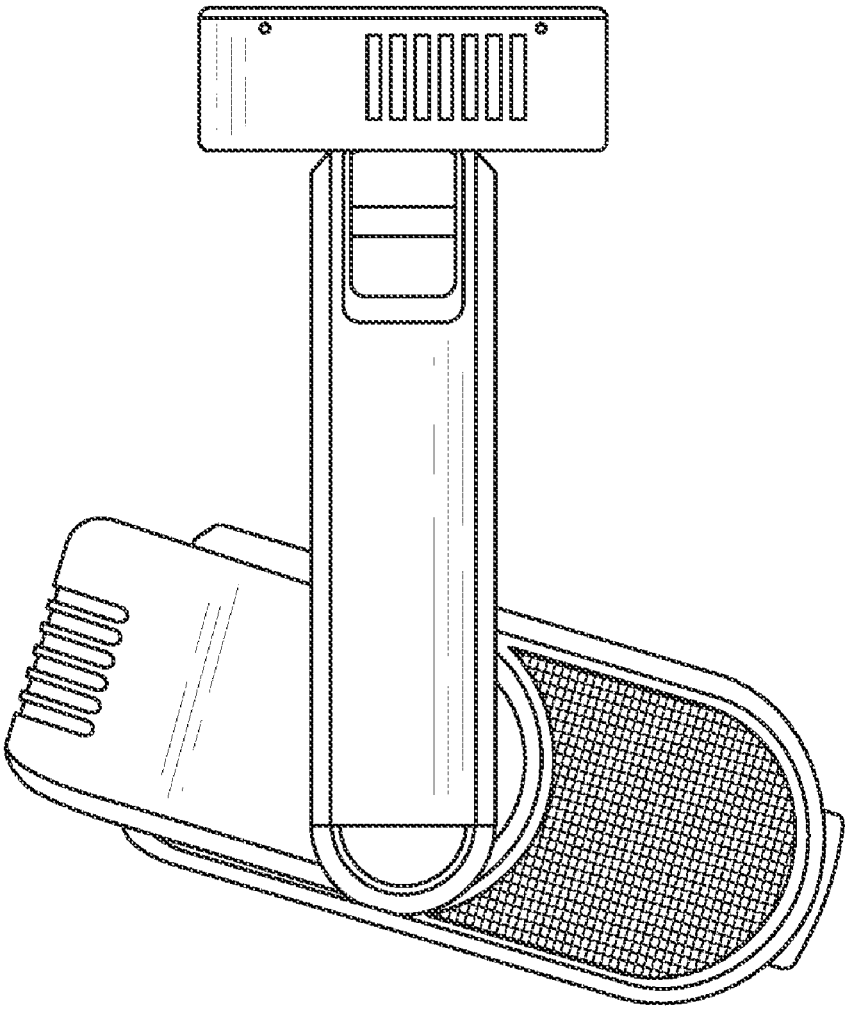
FIG. 4 shows a side view of the light.
Figure 5:
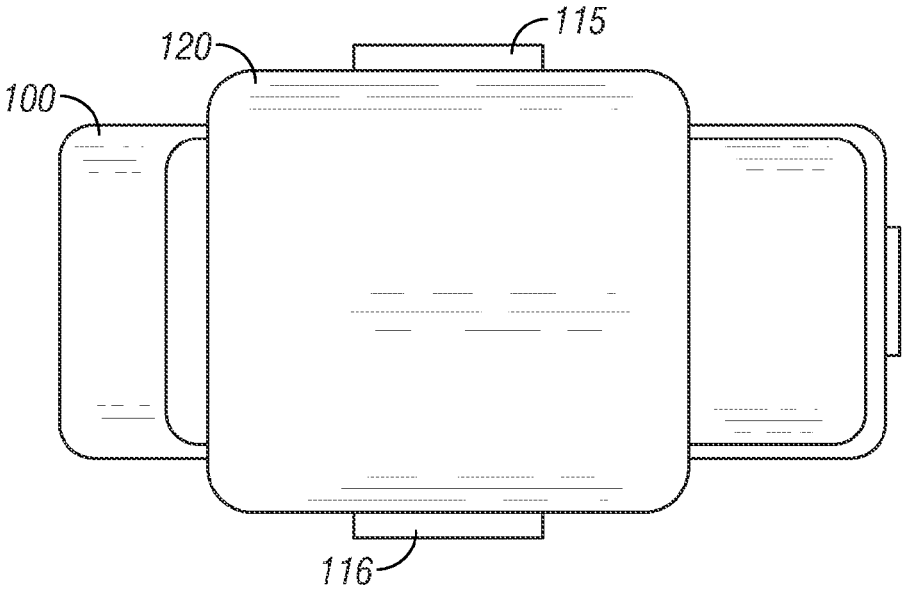
FIGS. 5 and 6 show top diagrams of the light.

FIG. 4 shows a side view of the light, showing the handles from this side view. FIG. 5 shows a top view of the lamp, showing the base 120, head 100, and the two arms of the yoke 115 and 116.

Figure 6:
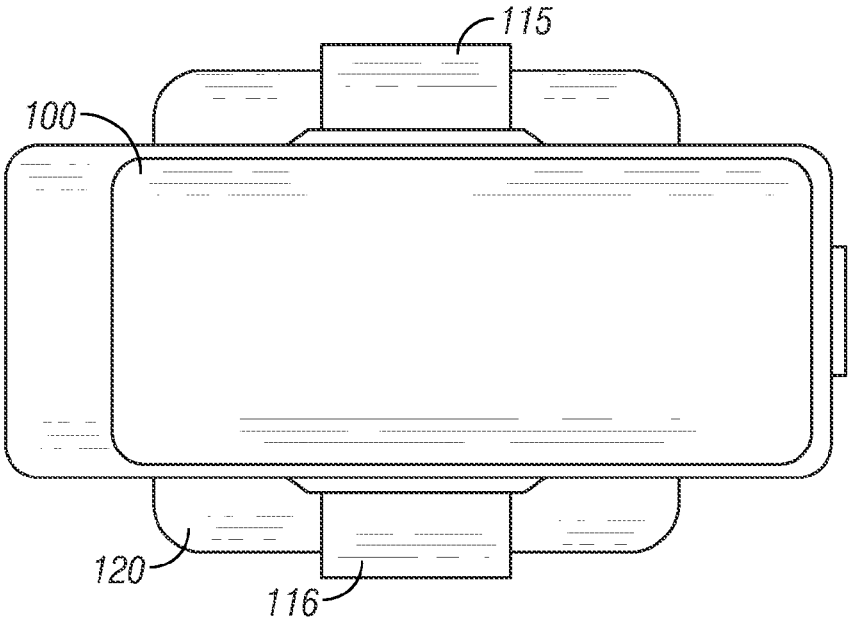

FIG. 6 shows a bottom view of the lamp, showing the head 100, the yoke arms 115, 116, and the base 120.

Figure 7:
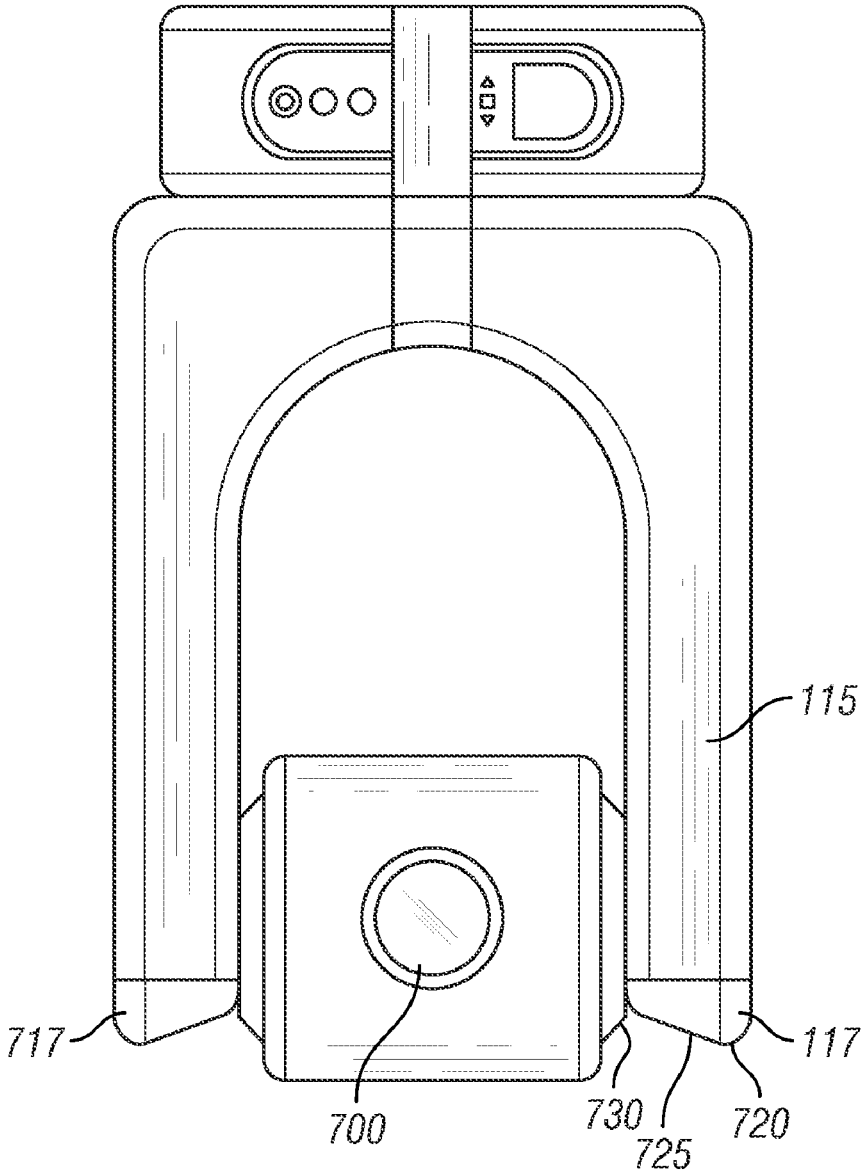
FIG. 7 shows a front-on diagram of the light.

FIG. 7 shows the front-on view of the lamp, showing its light projector lens 700, and showing how the two bottom handles are molded in a way that makes all outer surfaces rounded. The handle 117, 717 have open backs, but the rear surface always rests against the outer surface of the light head. Note that the bottom end of the handles press against the light, and that each of the handle such as 117 as a bottommost portion 720 tapering upward at 725 to the portion that interface is against the lamp 730. The bottommost edge of the handles is always lower than the center line of the lamp, that is the handles are slightly below the center of gravity of the lamp.

Figure 8:
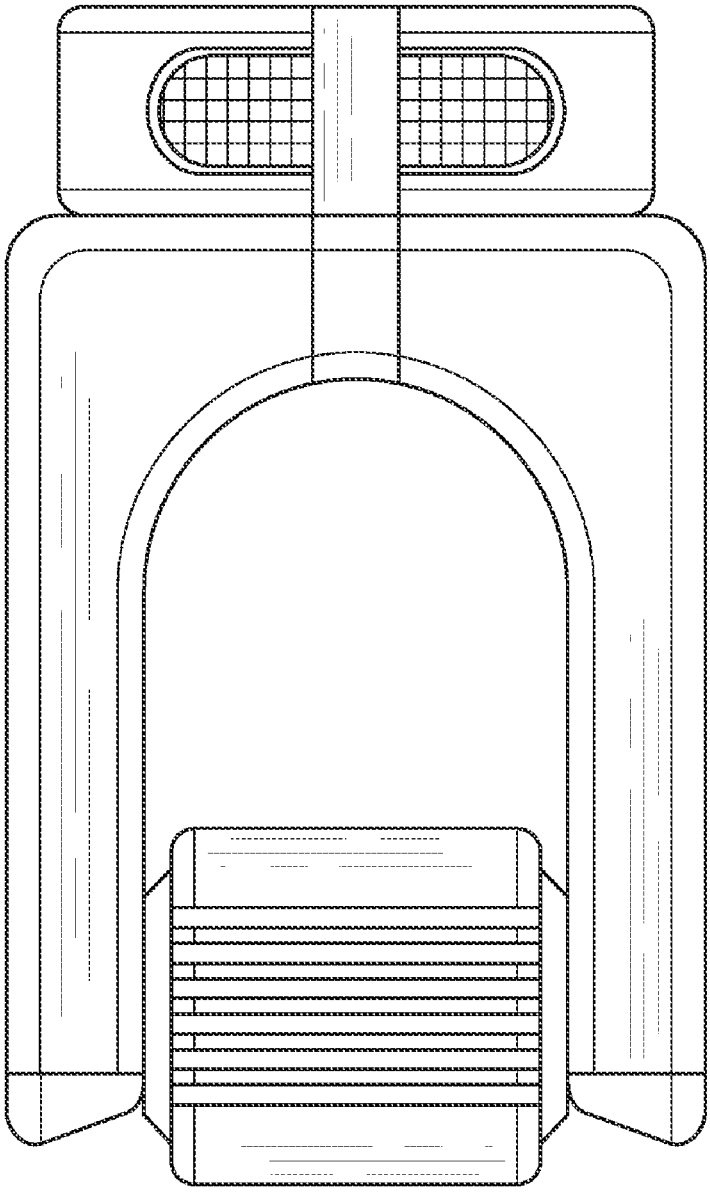
FIG. 8 shows a rear side diagram of the light.

FIG. 8 shows the lamp from the rear side.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other shapes of handles can be used. Also, the inventor intends that only those claims which use the words "means for" are intended to be interpreted under 35 USC 112, sixth paragraph. Moreover, no limitations from the specification are intended to be read into any claims, unless those limitations are expressly included in the claims.

This system can be used in the light of the type shown in FIG. 1 which can be controlled by a remote console, that communicates with the light over wired or wireless protocols such as DMX 512. Both the console and the light can include computers therein. The computers described herein may be any kind of computer, either general purpose, or some specific purpose computer such as a workstation. The computer may be an Intel (e.g., Pentium Core 2 duo) or AMD based computer, running Windows XP or Linux, or may be a Macintosh computer. The computer may also be a handheld computer, such as a PDA, cellphone, or laptop.

The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A lamp assembly, comprising:

a yoke which includes structure there which is controlled to cause a panning motion, said yoke having a bottom portion and a top portion and a flat outer surface, defining an outer surface of said yoke, which is curved near said top portion, and said curved portion includes a recessed portion therein which forms an area that is below said outer surface of said yoke;

a lamp head, which includes a light source therein, and coupled to said bottom portion of said yoke, and which moves to cause a tilting motion relative to the yoke; and wherein said yoke includes first and second handles attached thereto, said first handle being located in said recessed portion, such that no portion of said handle extends beyond a surface defined by said outer surface of said yoke and said yoke having said second handle attached to a top edge of said yoke.

2. A lamp assembly as in claim 1, wherein said second handle on the top portion of the yoke includes a handle portion which includes a curved surface, attached to an edge of the top portion of the yoke, said curved surface having an outer surface which is even with two sides of the yoke, and an inner surface, said inner surface being curved, wherein said outer surface forms a continuous surface with side surfaces of the yoke.

3. A lamp assembly as in claim 1, wherein said second handle on the topmost portion of the yoke also includes a handle portion which is indented relative to an outer surface of the yoke.

4. A lamp assembly as in claim 1, wherein said first and second handles have no portions which extend outside a surface defined by an outer surface defined by outer edges of said yoke.

5. An assembly as in claim 1, wherein one of said handles is below a center of gravity of the lamp assembly, and the other said handles is above the center of gravity of the moving head.

6. An assembly as in claim 5, wherein said second handle has an outer extent which forms a continuous curve, and the outermost portions of the handles forming distal edges of the curve are mated to and are the same size as outermost portions of the yoke.

7. An assembly as in claim 1, wherein said yoke includes a first arm and a second arm, and has handles at top and bottom of both of said first arm and said second arm.

8. An assembly as in claim 1, wherein all of said handles have only curved surfaces.

9. An assembly as in claim 1, wherein at least one of said handles has an open rear portion, and where said lamp head is behind said rear portion in all positions of said lamp head.

10. The assembly as in claim 1, wherein said handles are molded into said yoke.

11. A lamp assembly, comprising:

a base, a yoke, mounted on the base, and which is movable relative to the base, where said yoke is controlled to be rotated relative to the base to cause a panning motion, said yoke having a bottom portion and a top portion;

a lamp head, which includes a light source therein, and coupled to said bottom portion of said yoke, and which moves relative to said yoke to cause a tilting motion relative to the yoke, said lamp head emitting light from a first end; and wherein said yoke has first and second surfaces, pointing away from said lamp head and pointing facing opposite to one another, said first and second surfaces being substantially flat, and being curved in an area near where said yoke attaches to said base, and said yoke having third and fourth surfaces, coupled to said first surface, and substantially orthogonal to said first surface, and having fifth and sixth surfaces, coupled to said second surface, and substantially orthogonal to said second surface, wherein said yoke includes handles thereon, including a first handle that is attached to a bottom most portion of said yoke that is closest to said lamp head said first handle having outer surfaces which are the same size as, and form a continuous surface with, said third and fourth surfaces, and a second handle recessed in said curved portion of said yoke that is furthest from said lamp head.

12. A lamp assembly as in claim 11, wherein said first and second handles are molded on the yoke, with said first handle on the bottommost portion of the yoke includes a handle surface for holding the lamp which has an outer surface that is in a location that is even with an outer surface of the yoke, and has an inner surface that is indented relative to the outer surface of the yoke.

* * * * *